US011084278B2

(12) United States Patent
Fukakusa et al.

(10) Patent No.: US 11,084,278 B2
(45) Date of Patent: Aug. 10, 2021

(54) SCREEN PRINTING MACHINE HAVING MOVABLE COLLECTION MEMBER FOR COLLECTING VISCOUS FLUID

(71) Applicant: FUJI CORPORATION, Chiryu (JP)

(72) Inventors: Shoji Fukakusa, Yokkaichi (JP); Takeshi Kondo, Chiryu (JP)

(73) Assignee: FUJI CORPORATION, Chiryu (JP)

( * ) Notice: Subject to any disclaimer, the term of this patent is extended or adjusted under 35 U.S.C. 154(b) by 171 days.

(21) Appl. No.: 16/462,376

(22) PCT Filed: Nov. 24, 2016

(86) PCT No.: PCT/JP2016/084710
§ 371 (c)(1),
(2) Date: May 20, 2019

(87) PCT Pub. No.: WO2018/096607
PCT Pub. Date: May 31, 2018

(65) Prior Publication Data
US 2019/0337287 A1 Nov. 7, 2019

(51) Int. Cl.
*B41F 15/44* (2006.01)

(52) U.S. Cl.
CPC ..... *B41F 15/44* (2013.01)

(58) Field of Classification Search
CPC ..... B41F 15/40; B41F 15/42; B41F 15/44; B41F 15/46; B41F 15/08
See application file for complete search history.

(56) References Cited

U.S. PATENT DOCUMENTS

2013/0087057 A1 4/2013 Kondo et al.

FOREIGN PATENT DOCUMENTS

| | | | |
|---|---|---|---|
| JP | 5-193105 A | | 8/1993 |
| JP | 06316056 A | * | 11/1994 |
| JP | 8-309958 A | | 11/1996 |
| JP | 2011-230353 A | | 11/2011 |
| JP | 2017071072 A | * | 4/2017 |

OTHER PUBLICATIONS

International Search Report dated Jan. 31, 2017 in PCT/JP2016/084710 filed Nov. 24, 2016.

* cited by examiner

*Primary Examiner* — Leslie J Evanisko
(74) *Attorney, Agent, or Firm* — Oblon, McClelland, Maier & Neustadt, L.L.P.

(57) ABSTRACT

An object is to provide a screen printing machine capable of one-way printing on multiple boards. Solder collecting device includes collecting plate moving device, collecting plate, and scraper. Second slider of collecting plate moving device is movable in a front-rear direction along a second guide rail, and is also movable in an up-down direction. Collecting plate is placed on second slider. After squeegee passes by the tail end of printing region of mask, collecting plate is disposed so as to be positioned rearward of squeegee and collects the cream solder moved by the rearward movement of squeegee. Scraper is attached to collecting plate to be movable in a left-right direction and collects the cream solder remaining on mask.

10 Claims, 8 Drawing Sheets

SCREEN PRINTING MACHINE HAVING MOVABLE COLLECTION MEMBER FOR COLLECTING VISCOUS FLUID

TECHNICAL FIELD

The present application relates to a screen printing machine for printing a viscous fluid on a board.

BACKGROUND ART

Screen printing machines that print viscous fluids at predetermined positions on a board when components are mounted on the board are known. Patent Literature 1 discloses a screen printing machine in which cream solder, which is an example of a viscous fluid, is moved on a mask placed on a board by a squeegee and printed on the board through a through hole formed in the mask.

PATENT LITERATURE

Patent Literature 1: JP-A-2011-230353

BRIEF SUMMARY

Technical Problem

In the screen printing machine, when the moved cream solder for printing the first board is returned to the original position, the next board is printed with the cream solder being moved on the mask, where the next board is installed, in an opposite direction for printing the first board. Therefore, the printing quality varies depending on the difference in the printing direction, and it is difficult to stabilize the printing quality.

An object of the present disclosure is to provide a screen printing machine capable of performing printing on multiple boards to be printed by the same mask in one direction.

Solution to Problem

In order to solve the above problems, the present disclosure provides a screen printing machine comprising: a main body frame, a squeegee configured to be used for printing a viscous fluid on a mask placed on the main body frame on a board and to be movable in a first direction from a first end to a second end of the mask, a collection member configured to be movable in the first direction and collect the viscous fluid moved by the squeegee, and a driving section configured to move the squeegee and the collection member; the driving section disposes the collection member closer to the first end side of the mask than the squeegee before the squeegee moving in the first direction enters a printing region of the mask, and disposes the collection member closer to the second end side of the mask than the squeegee after the squeegee moving in the first direction passes by a printing region of the mask.

With the above configuration, the driving section moves the viscous fluid on the mask in the first direction by moving the squeegee in the first direction. As the squeegee moves over the mask, printing of the viscous fluid is performed on the board. The collection member is disposed on any one of the first end side and the second end side with respect to the squeegee. Since the collection member is disposed closer to the first end side of the mask than the squeegee before the squeegee enters the printing region of the mask, printing can be started without replacing the positions of the squeegee and the collection member with each other. In addition, since the collection member is disposed on the second end side with respect to the squeegee after the squeegee passes by the printing region of the mask, the collection member is positioned ahead of the squeegee moving in the first direction. Therefore, the viscous fluid can be collected by the collection member.

In the screen printing machine, the driving section may move at least one of the squeegee and the collection member so that the collection member disposed, before the squeegee enters the printing region of the mask, on the second end side of the mask with respect to the squeegee is disposed on the first end side of the mask with respect to the squeegee, and move the viscous fluid placed on the collection member onto the mask.

According to the above configuration, the viscous fluid on the collection member can be moved in the first direction and can be moved from the collection member onto the mask, by moving the squeegee in the first direction relative to the collection member.

Further, in the screen printing machine, the squeegee and the collection member may be movable in an up-down direction, at least one of the squeegee and the collection member may be driven to move the viscous fluid placed on the collection member onto the mask before the squeegee moving in the first direction enters the printing region of the mask and then move the viscous fluid placed on the mask onto the collection member after the squeegee passes by the printing region of the mask, and the driving section may move the collection member disposed on the first end side of the mask with respect to the squeegee so as to be disposed on the second end side of the mask with respect to the squeegee, in a state where a height of the collection member is set to differ from a height of the squeegee, during a period from when the viscous fluid is moved from the collection member onto the mask until the viscous fluid is moved from the mask onto the collection member.

According to the above configuration, the height of the collection member is different from the height of the squeegee, and thus the collection member may be moved in the first direction until the collection member overtakes the squeegee, and the collection member may be disposed on the second end side of the mask with respect to the squeegee.

Further, in the screen printing machine, the driving section may move the collection member disposed on the first end side of the mask with respect to the squeegee so as to be disposed on the second end side of the mask with respect to the squeegee, in a state where the collection member and the squeegee are disposed at a position higher than the viscous fluid and the collection member is disposed at a position lower than the squeegee, during a period from when the squeegee passes by the printing region of the mask until the viscous fluid is moved from the mask onto the collection member.

According to the above configuration, the height of the collection member is different from the heights of the viscous fluid and the squeegee, and thus the collection member can pass between the squeegee and the viscous fluid. Therefore, it is possible to minimize the up-down movement distance of the collection member, which is required to position the collection member on the second end side of the mask with respect to the squeegee, and to reduce an operation time.

In the screen printing machine, the driving section may move at least one of the squeegee and the collection member so that the collection member disposed on the second end side of the mask with respect to the squeegee comes into contact with the squeegee after the squeegee passes by the printing region of the mask, and move the viscous fluid placed on the mask onto the collection member.

With the above configuration, since the squeegee is moved in the first direction relative to the collection member so that the squeegee and the collection member come into contact with each other, the viscous fluid can be collected from the mask to the collection member.

Further, in the screen printing machine, the squeegee and the collection member may be movable in a second direction opposite to the first direction, at least one of the squeegee and the collection member may be driven to move the viscous fluid placed on the mask onto the collection member after the squeegee passes by the printing region of the mask, and the driving section may move the squeegee and the collection member in the second direction so that the collection member is disposed between the printing region of the mask and the first end of the mask, after the viscous fluid is moved from the mask onto the collection member.

With the above configuration, the viscous fluid is moved in the second direction while being placed on the collection member. Therefore, the viscous fluid is not moved over the mask in the second direction. That is, since the board is normally printed only in the first direction, the quality of printing can be stabilized.

The screen printing machine may further include a scraper which is attached to the collection member and is configured to collect the viscous fluid protruding outward from the squeegee in a longitudinal direction of the squeegee when the squeegee is moved in the first direction.

With the above configuration, since the scraper is not attached to the squeegee, the height of the scraper, which influences the pressing force of the scraper on the mask, can be set individually regardless of the height of the squeegee. Therefore, the pressing force of the scraper on the mask can be optimized.

Further, in the screen printing machine, the collection member may be disposed so that a longitudinal direction of the collection member is parallel to the longitudinal direction of the squeegee, the scraper may include two scraping units provided to be spaced apart from each other in the longitudinal direction of the collection member, and each of the two scraping units may be formed to extend from the collection member in a direction including a component of the first direction and to have a tip end which is positioned outside the squeegee in the longitudinal direction of the squeegee.

With the above configuration, the viscous fluid protruding outward from the squeegee in the longitudinal direction of the squeegee can be collected to the collection member by the two scraping units.

In order to solve the above-mentioned problems, the present disclosure provides a screen printing system comprising: a main body frame; a squeegee configured to be used for printing a viscous fluid on a mask placed on the main body frame on a board and to be movable in a first direction from a first end to a second end of the mask; a collection member configured to be movable in the first direction and collect the viscous fluid moved by the squeegee; a driving section configured to move the squeegee and the collection member; and a control section configured to control the driving section, wherein the control section controls the driving section so that the collection member is disposed closer to the first end side of the mask than the squeegee before the squeegee moving in the first direction enters a printing region of the mask, and controls the driving section so that the collection member is disposed closer to the second end side of the mask than the squeegee after the squeegee moving in the first direction passes by the printing region of the mask.

Advantageous Effect

With the above-described configuration, the screen printing machine can perform one-way printing, and thus the printing quality is stabilized.

DESCRIPTION OF EMBODIMENTS

Hereinafter, an embodiment of the present disclosure will be described in detail with reference to the drawings.

Figure 1:
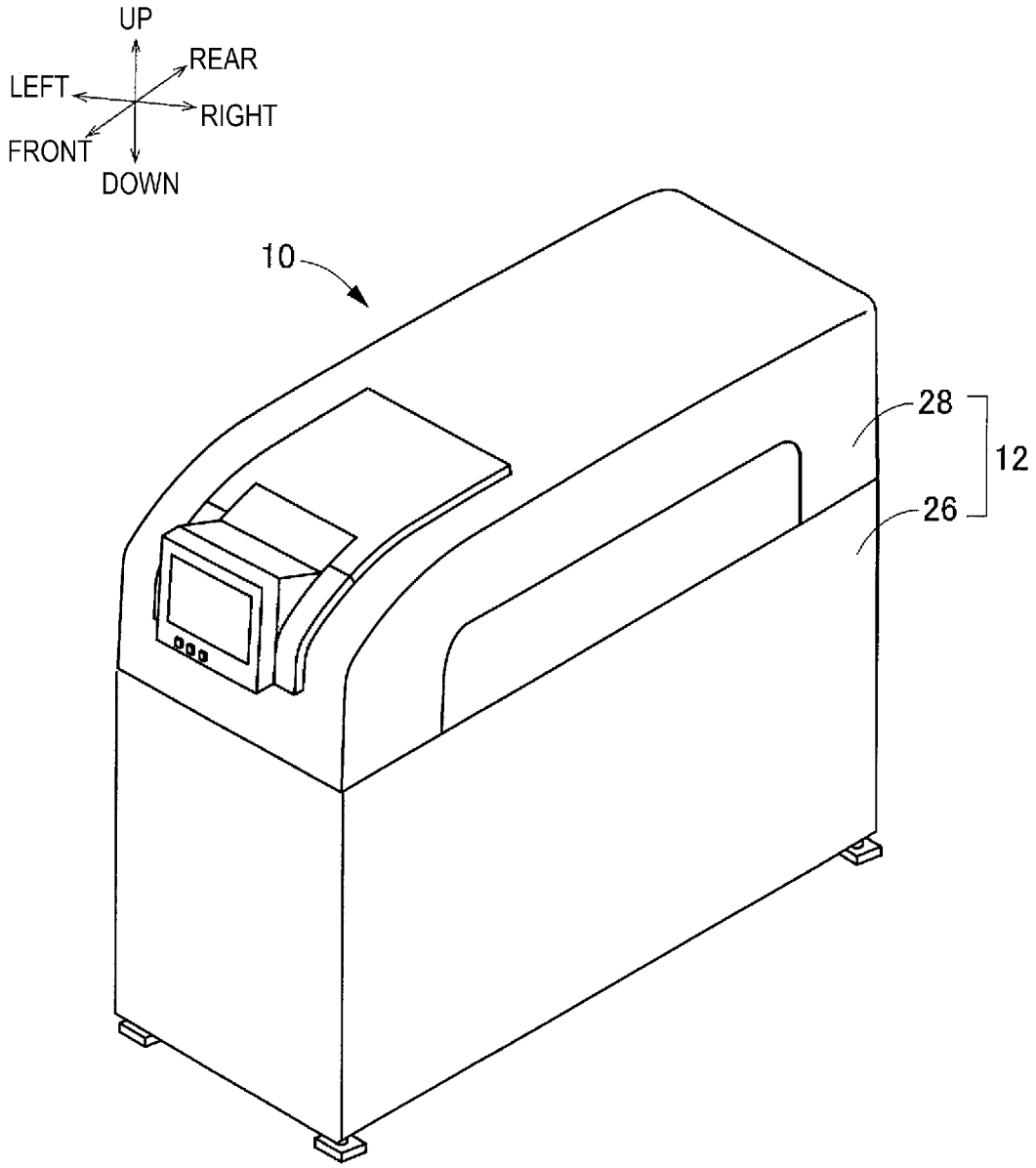
FIG. 1 is a diagram illustrating an overall configuration of a screen printing machine according to a first embodiment.
Figure 2:
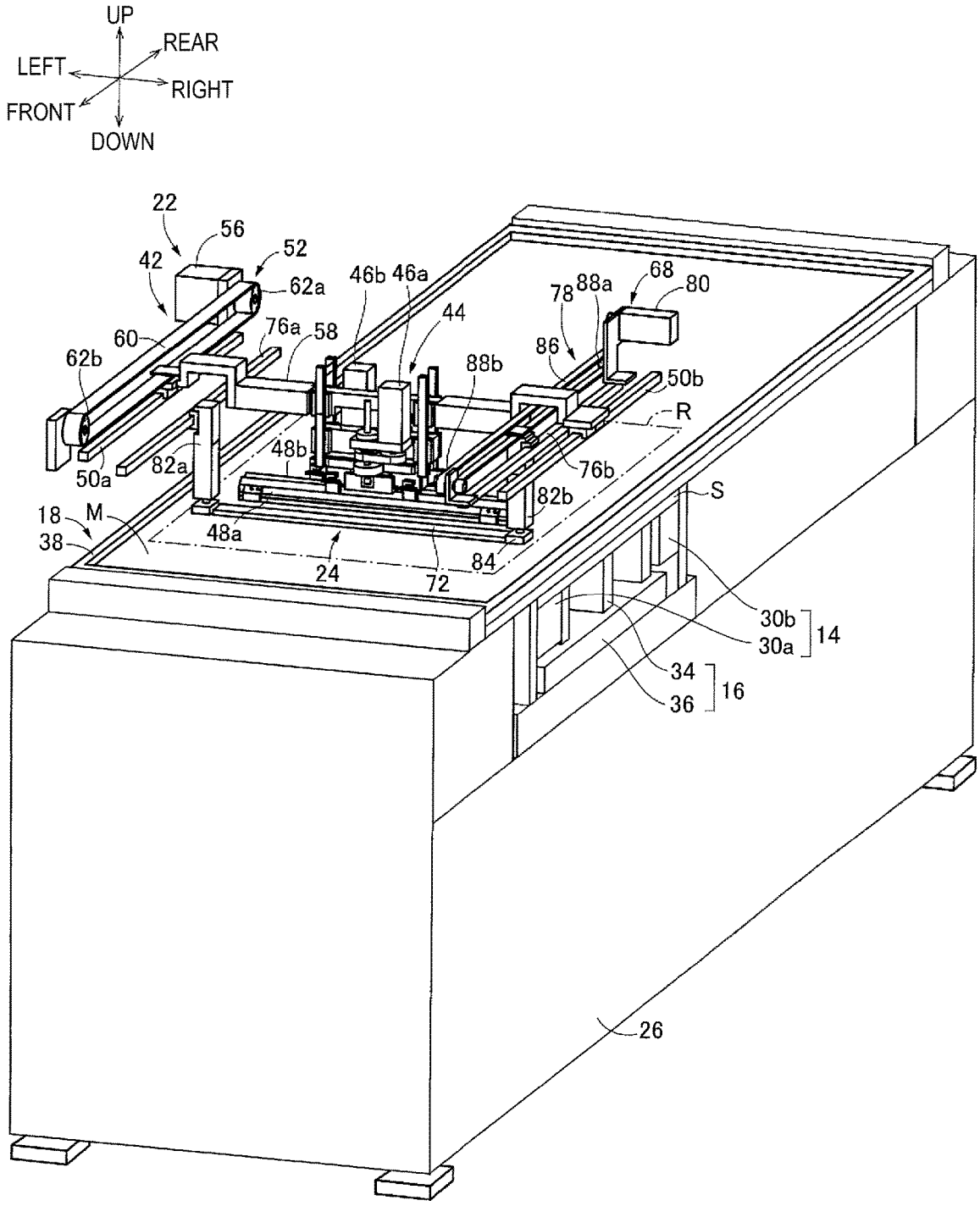
FIG. 2 is a diagram when a cover of the screen printing machine in the first embodiment is removed.
Figure 3:
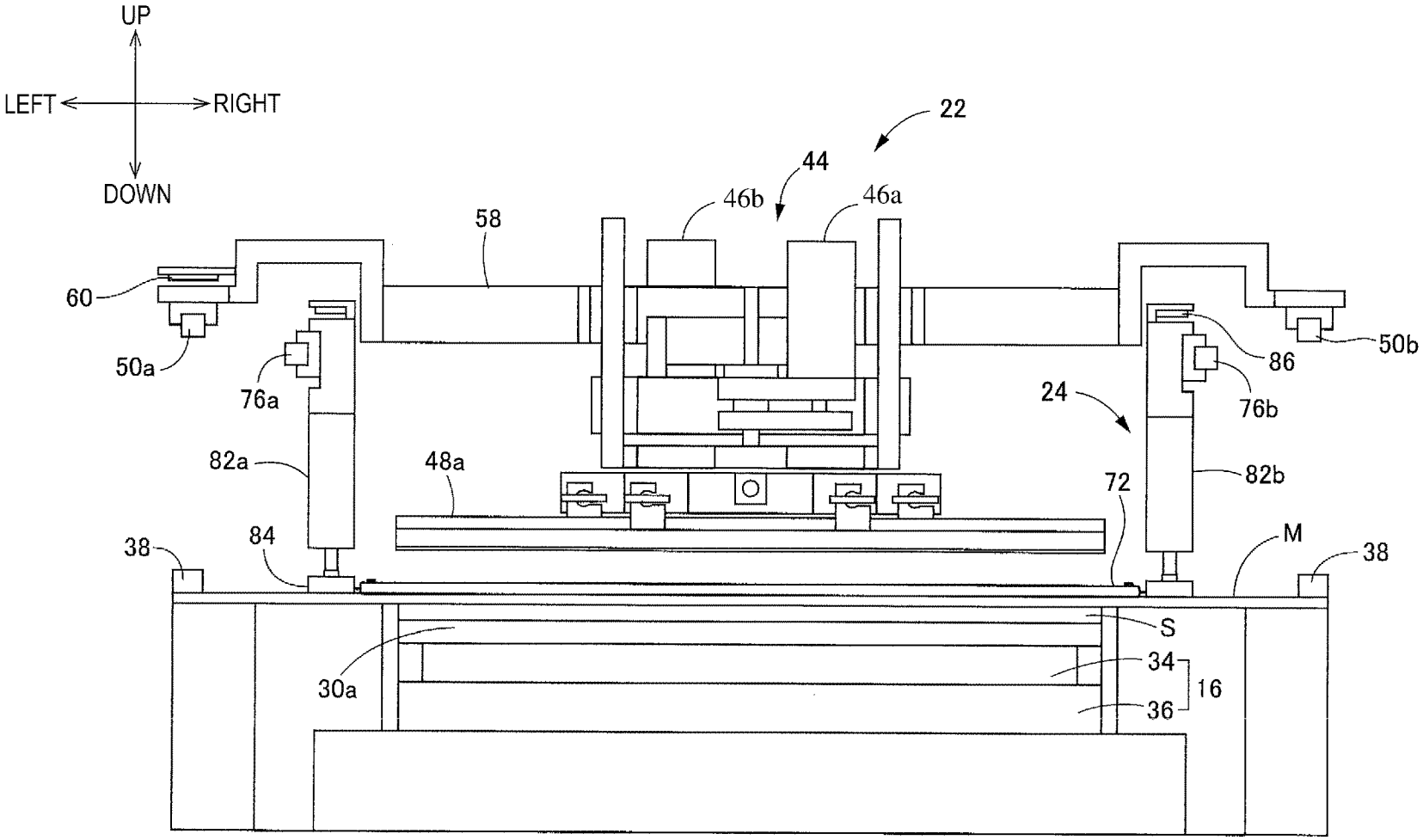
FIG. 3 is a front view illustrating the screen printing machine in the first embodiment.

FIG. 1 is an overall view of screen printing machine 10 according to a first embodiment. FIG. 2 is a perspective view of the first embodiment of screen printing machine 10 in FIG. 1 with cover 28 removed. FIG. 3 is a front view of screen printing machine 10 of the first embodiment.

As shown in FIG. 1, the front-rear direction of screen printing machine 10 is defined with the surface of screen printing machine 10 on which the operator panel is disposed, as the front face, the left-right direction as viewed from the operator is defined as the left-right direction of screen printing machine 10, and the direction orthogonal to the front-rear direction and the left-right direction is defined as the up-down direction. The up-down direction is a direction parallel to the vertical direction. Screen printing machine 10 performs an operation (solder printing operation) of printing the cream solder on board S through the through holes formed in printing region R of mask M by moving the cream solder on mask M placed on the frame along mask M.

Screen printing machine 10 includes printer main body 12, board conveyance device 14, board holding device 16, mask holding device 18, squeegee device 22, solder collecting device 24, and the like. As shown in FIG. 1, printer main body 12 includes main body frame 26 and cover 28. Main body frame 26 is configured with three stages, and the board conveyance device 14 and board holding device 16 are provided in the lower stage, and mask holding device 18 is provided in the middle stage. Squeegee device 22 and solder collecting device 24 are provided on the upper stage of printer main body 12. Cover 28 covers the upper and middle stages of main body frame 26.

Board conveyance device 14 transports board S from the left to the right. Board conveyance device 14 carries board S to a position immediately below printing region R of mask M, and after the solder printing operation is completed, carries board S out to a mounting device (not shown). As shown in FIG. 2, board conveyance device 14 includes two conveyor belts 30*a* and 30*b* and conveyance motor 32 (see FIG. 6) which will be described later. Each of conveyor belts 30*a* and 30*b* is supported by two pulleys and is spaced apart from each other. Conveyor belts 30*a* and 30*b* are rotated by a conveyance motor 32 to convey board S placed on conveyor belts 30*a* and 30*b*.

Board holding device 16 moves board S conveyed directly under printing region R of mask M in the up-down direction. Board holding device 16 includes holding member 34 for holding board S, and board lifting and lowering device 36 for moving holding member 34 in the up-down direction. Board lifting and lowering device 36 moves holding member 34 holding board S upward during the solder printing operation, and presses board S against the lower face of printing region R of mask M disposed above.

Mask holding device 18 includes mask frame 38 and a mask fixing cylinder (not shown). Mask frame 38 is formed in a shape overlapping with the end portion of mask M. A mask frame support portion is disposed above mask frame 38, and holds mask M horizontally by pushing down mask frame 38 from above and bringing it into contact with the mask frame support portion.

Squeegee device 22 prints the cream solder on board S by moving the cream solder on mask M along mask M. As shown in FIGS. 2 and 3, squeegee device 22 includes squeegee moving device 42, squeegee head 44, squeegee lifting and lowering devices 46*a* and 46*b*, and squeegees 48*a* and 48*b*. Squeegee moving device 42 includes first guide rails 50*a* and 50*b*, first conveyor 52, squeegee moving motor 56, and first slider 58. First guide rails 50*a* and 50*b* are spaced apart from each other in the left-right direction so as to be parallel to the front-rear direction. First conveyor 52 includes first conveyor belt 60 and first pulleys 62*a* and 62*b*. First conveyor belt 60 is an endless belt and is rotatably supported by first pulleys 62*a* and 62*b*.

First pulleys 62*a* and 62*b* are disposed above first guide rail 50*a* so as to have the same height as each other. First pulley 62*a* is rotated by squeegee moving motor 56 provided to the left of first pulley 62*a*. First pulley 62*b* rotates by rotating first pulley 62*a*, and first conveyor belt 60 is wound between first pulley 62*a* and first pulley 62*b*.

First slider 58 is formed in an elongated shape, and is arranged so that the longitudinal direction thereof is parallel to the left-right direction. The left end portion and the right end portion of first slider 58 in the left-right direction are attached to first guide rails 50*a* and 50*b* so as to be movable in the front-rear direction, respectively. The left end of first slider 58 is also fixed to first conveyor belt 60 in a relatively immobile manner above the attachment portion with first guide rail 50*a*. Therefore, first slider 58 is moved in the front-rear direction along with the rotation of first conveyor belt 60 by squeegee moving motor 56.

Squeegee head 44 is fixed to the center of first slider 58. Squeegee lifting and lowering devices 46*a* and 46*b* are fixed to squeegee head 44. Squeegees 48*a* and 48*b* are attached to the lower ends of squeegee lifting and lowering devices 46*a* and 46*b*, respectively. Squeegees 48*a* and 48*b* are plate-like members having a longitudinal direction, and are attached to squeegee lifting and lowering devices 46*a* and 46*b* so that the longitudinal direction thereof is parallel to the left-right direction. Further, squeegees 48*a* and 48*b* are held in a state of being inclined at a predetermined angle with respect to mask M in a lateral direction which is a direction perpendicular to the longitudinal direction.

Squeegees 48*a* and 48*b* are supported by squeegee lifting and lowering devices 46*a* and 46*b* so as to be movable in the up-down direction independently of each other. When squeegee 48*a* is moved in a direction from the front end of mask M toward the tail end of mask M, that is, squeegee 48*a* is moved rearward, in a state where squeegee 48*a* is in contact with mask M, the cream solder is moved rearward by squeegee 48*a* and the cream solder is printed on board S. As shown in FIG. 2, squeegee 48*b* is not moved from a state in which it is spaced apart upward from mask M, and is not involved in the solder printing operation, and therefore, the description of squeegee 48*b* is omitted below.

Solder collecting device 24 includes collecting plate moving device 68, collecting plate 72, and scraper 74. Collecting plate moving device 68 includes second guide rails 76*a* and 76*b*, second conveyor 78, collecting plate moving motor 80, air cylinders 82*a* and 82*b*, and second slider 84. Second guide rails 76*a* and 76*b* are arranged to be spaced apart from each other in the left-right direction so as to be parallel to the front-rear direction. Second guide rails 76*a* and 76*b* are arranged so as to be positioned inside and below first guide rails 50*a* and 50*b* in the left-right direction.

Second conveyor 78 includes second conveyor belt 86 and second pulleys 88*a* and 88*b*. Second conveyor belt 86 is an endless belt and is rotatably supported by second pulleys 88*a* and 88*b*. Second pulleys 88*a* and 88*b* are disposed above second guide rail 76*b* so as to have the same height as each other. Second pulley 88*a* is rotated by collecting plate moving motor 80 provided to the left of second pulley 88*a*. Second pulley 88*b* is rotated by the rotation of second pulley 88*a*, and second conveyor belt 86 is wound between second pulley 88*a* and second pulley 88*b*.

The upper end portions of air cylinders 82*a* and 82*b* are attached to second guide rails 76*a* and 76*b* so as to be movable in the front-rear direction, respectively. Air cylinder 82*b* is fixed to second conveyor belt 86 above the attachment portion to second guide rail 76*b* in a relatively immobile manner. Therefore, air cylinders 82*a* and 82*b* are moved in the front-rear direction along with the rotation of second conveyor belt 86 by collecting plate moving motor 80.

Figure 4:
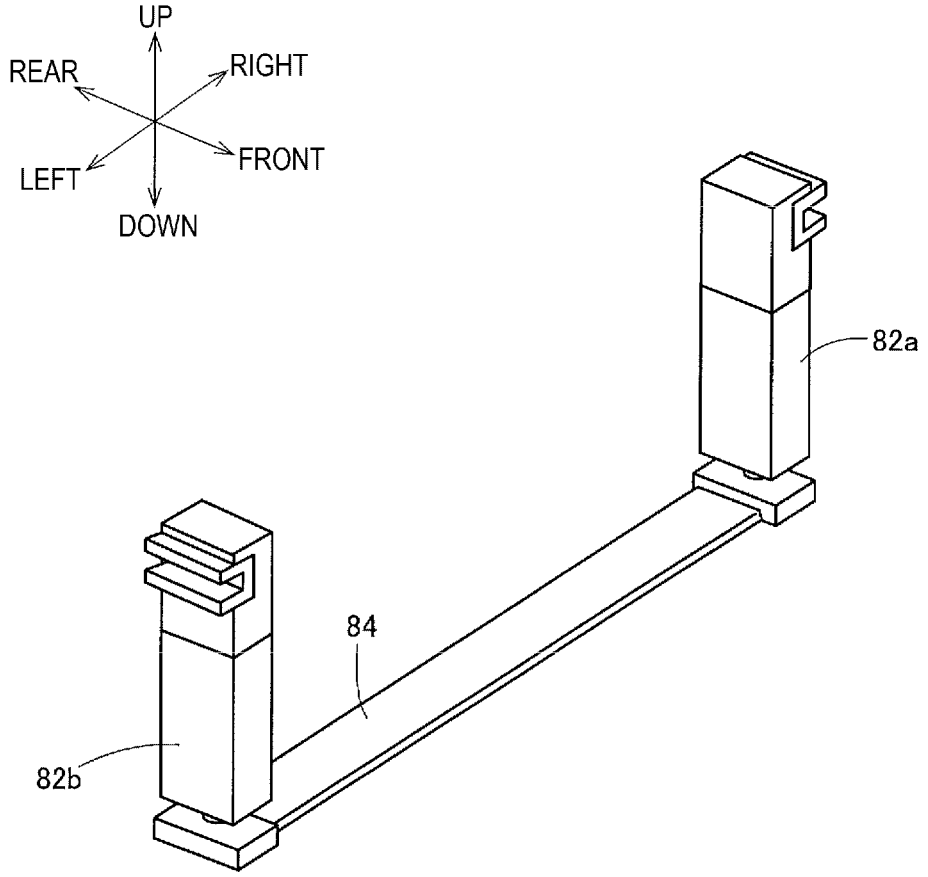
FIG. 4 is a diagram illustrating a solder collecting device of the screen printing machine in the first embodiment.

FIG. 4 is a view showing solder collecting device 24 in a state in which collecting plate 72 of the first embodiment is not attached. Air cylinders 82*a* and 82*b* extend downward from the attachment portions with second guide rails 76*a* and 76*b*, respectively, and second slider 84 is attached to the lower end portion thereof. Air cylinders 82*a* and 82*b* move second slider 84 in the up-down direction. As shown in FIG. 4, second slider 84 is a plate-like member of which longitudinal direction is arranged to be parallel to the left-right direction. The left end portion and the right end portion of second slider 84 in the longitudinal direction are attached to the lower ends of air cylinders 82*a* and 82*b*, respectively. Therefore, second slider 84 is movable in the front-rear direction and the up-down direction.

Figure 5:
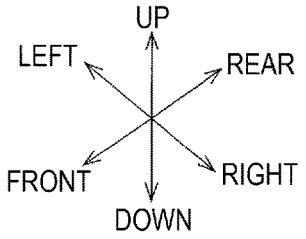
FIG. 5 is a perspective view illustrating a collecting plate of the screen printing machine in the first embodiment.
Figure 5:
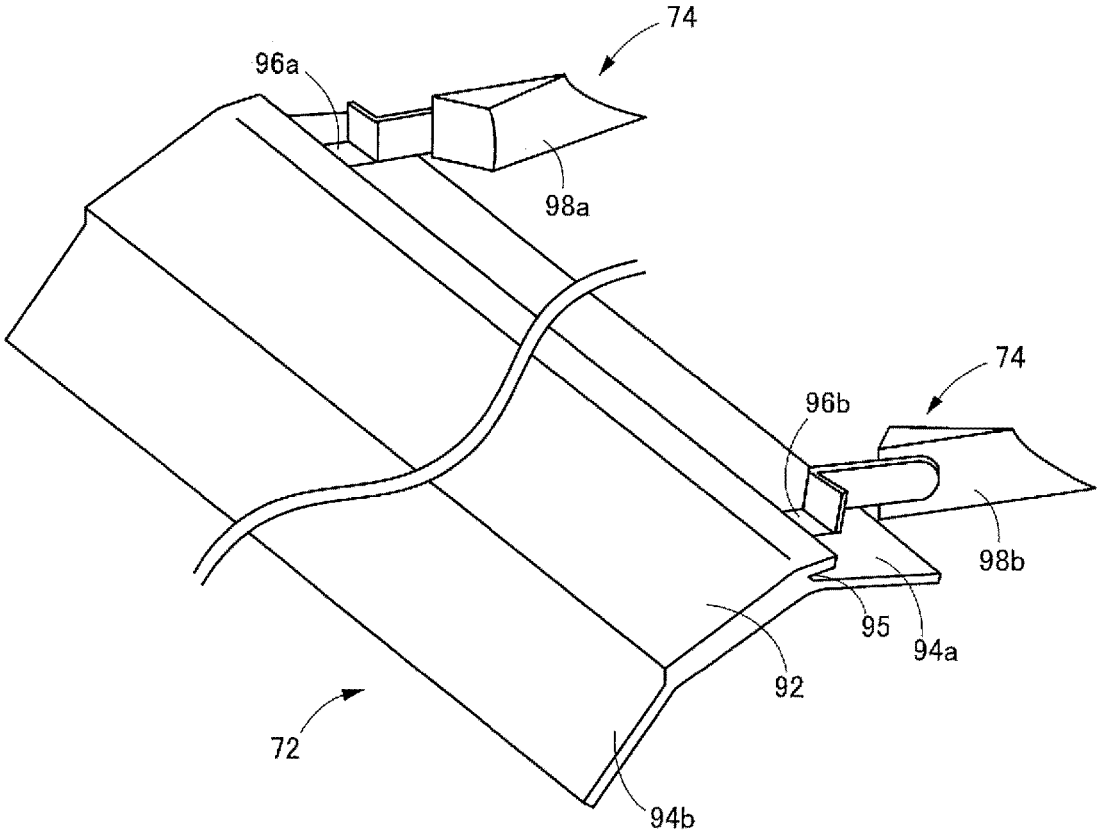

FIG. 5 is a perspective view when collecting plate 72 employed in screen printing machine 10 of the first embodiment is viewed from the above and the front. Collecting plate 72 collects the cream solder by squeegee 48*a* and moves the cream solder. As shown in FIG. 5, collecting plate 72 is a plate-like member having a longitudinal direction, and is arranged so that the longitudinal direction thereof is parallel to the left-right direction. The length of collecting plate 72 in the longitudinal direction is formed to be shorter than the length of second slider 84 in the longitudinal direction. The width of collecting plate 72 in the front-rear direction is formed to be larger than the width of second slider 84 in the front-rear direction. Therefore, collecting plate 72 is placed so as to cover the upper face of second slider 84.

Horizontal surface 92 and inclined surfaces 94*a* and 94*b* are formed on collecting plate 72. Inclined surface 94*a* extends from the tail end of horizontal surface 92 in the front-rear direction, and is inclined downward from horizontal surface 92 so as to be positioned downward as it progresses rearward. Inclined surface 94*b* extends from the front end of horizontal surface 92, and is inclined downward from horizontal surface 92 so as to be positioned downward as it progresses forward. Guide groove 95 extending in parallel to the left-right direction is formed at a boundary portion between horizontal surface 92 and inclined surface 94*a*. The length of guide groove 95 in the left-right direction is formed to be longer than the length of squeegee 48*a* in the left-right direction. Support portions 96*a* and 96*b* are fitted into guide groove 95, and guide groove 95 holds support portions 96*a* and 96*b* movably in the left-right direction.

Scraper 74 collects the cream solder remaining on mask M after the cream solder is moved on mask M by squeegee 48*a*. As shown in FIG. 5, scraper 74 includes support portions 96*a* and 96*b* and scraping units 98*a* and 98*b*. Support portions 96*a* and 96*b* are fitted in guide groove 95 so as to be movable in the left-right direction. The support portions 96*a* and 96*b* extend downward. Scraping units 98*a* and 98*b* are fixed to the tip ends of the support portions 96*a* and 96*b*, respectively. Scraping units 98*a* and 98*b* have an inclined surface positioned outside squeegee 48*a* in the left-right directions as they move forward. The tip ends of scraping units 98*a* and 98*b* are disposed so as to be positioned lower than the lower end of inclined surface 94*a*. Therefore, when collecting plate 72 is brought into contact with mask M, scraping units 98*a* and 98*b* are brought into contact with mask M before collecting plate 72 is brought into contact with mask M.

Figure 6:
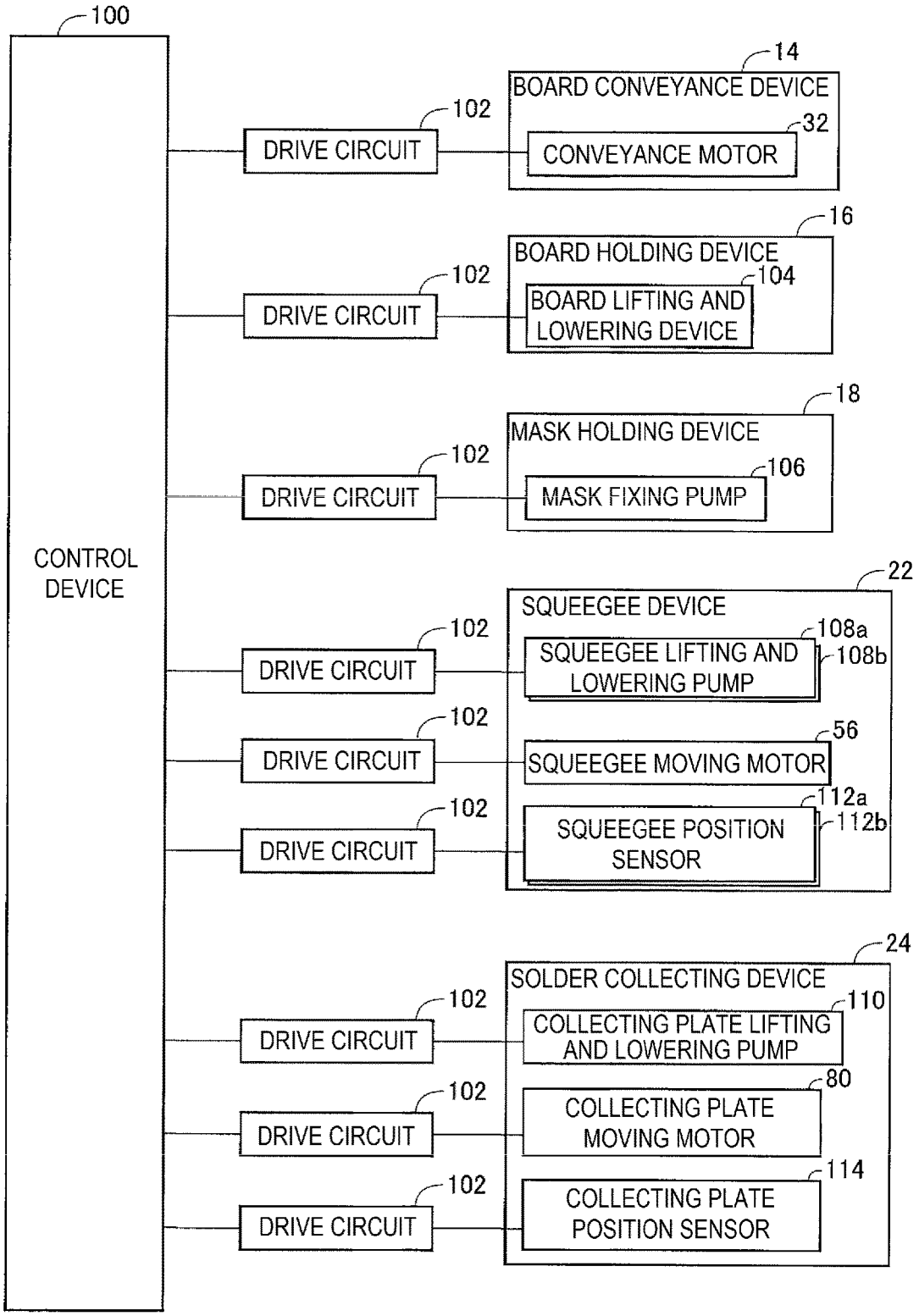
FIG. 6 is a block diagram illustrating electrical connection of a control device of a screen printing machine in the first embodiment.

FIG. 6 is a block diagram showing the electrical connection of control device 100 of screen printing machine 10. Control device 100 includes a CPU, a ROM, a RAM, a ROM that can be temporarily stored, a communication interface, and the like, and performs various controls by executing a program recorded in the ROM on the CPU. As shown in FIG. 6, control device 100 is connected to conveyance motor 32, board lifting and lowering pump 104, mask fixing pump 106, squeegee lifting and lowering pumps 108*a* and 108*b*, squeegee moving motor 56, collecting plate moving motor 80, collecting plate lifting and lowering pump 110, squeegee position sensors 112*a* and 112*b*, and collecting plate position sensor 114 via drive circuit 102.

Board lifting and lowering pump 104, mask fixing pump 106, squeegee lifting and lowering pumps 108*a* and 108*b*, and collecting plate lifting and lowering pump 110, drive board lifting and lowering device 36, the mask fixing cylinder, squeegee lifting and lowering devices 46*a* and 46*b*, and air cylinders 82*a* and 82*b*, respectively. Squeegee position sensors 112*a* and 112*b* and collecting plate position sensor 114 detect positions of squeegees 48*a* and 48*b* and collecting plate 72 in the front-rear direction and the up-down direction, respectively.

The solder printing operation by screen printing machine 10 having the above-described configuration will be described. FIGS. 7A to 7G are a series of diagrams showing a state at the time of one-way printing by screen printing machine 10. First, the operator attaches mask M to mask holding device 18 in preparation for the solder printing operation. Subsequently, the operator removes collecting plate 72 from second slider 84, moves support portions 96*a* and 96*b* of scraper 74 in the left-right direction, and adjusts the distance between the inner end portions of the scraping units 98*a* and 98*b* in the left-right direction to be longer than the lengths of squeegees 48*a* and 48*b* in the longitudinal direction. Thereafter, the operator places a predetermined amount of the cream solder on collecting plate 72, and attaches collecting plate 72 to second slider 84.

Figure 7:
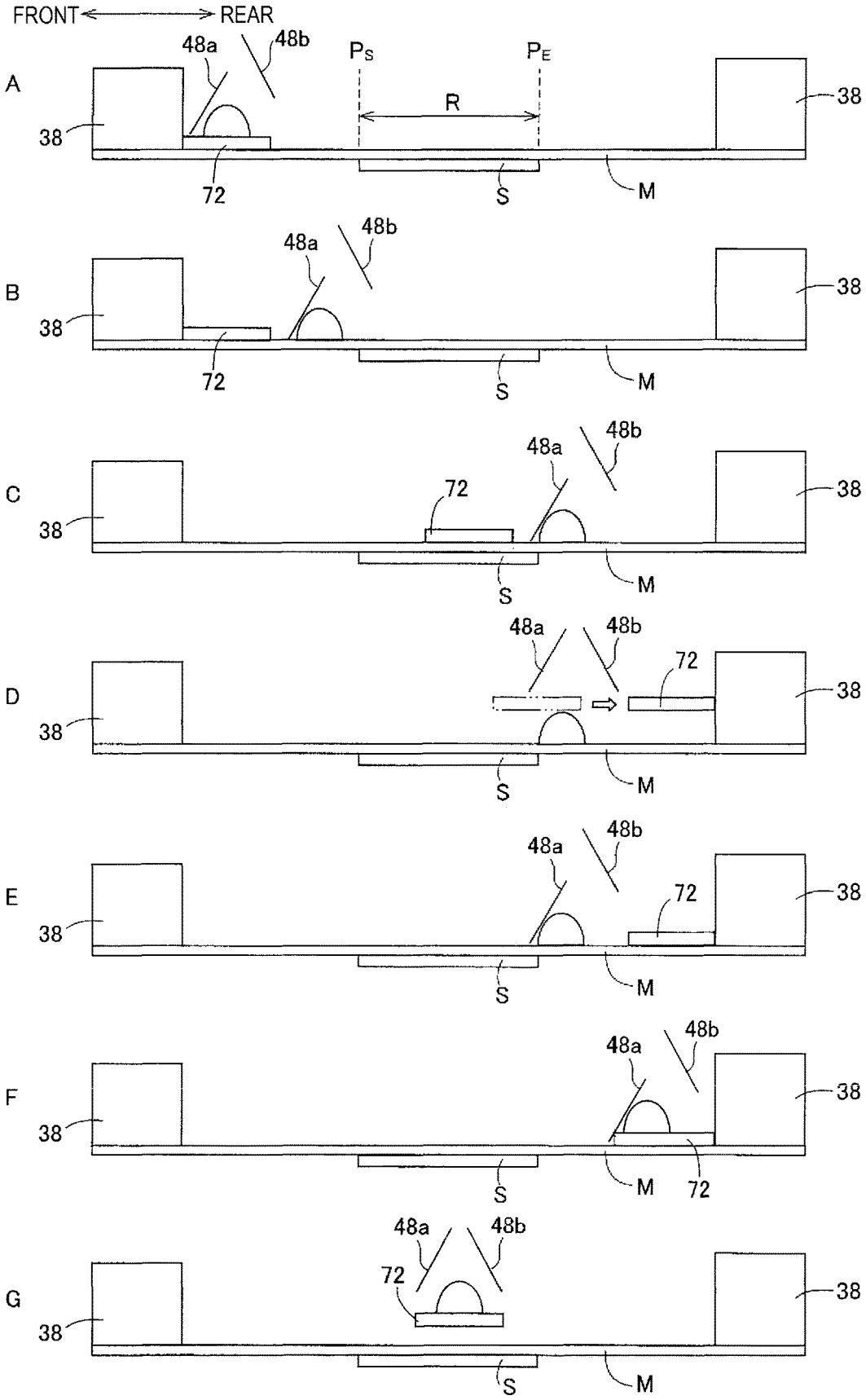
FIG. 7A to FIG. 7G are diagrams illustrating a state at the time of one-way printing by the screen printing machine of the first embodiment.

When the preparation of the solder printing operation by the operator is completed, board S is carried onto board holding device 16 by board conveyance device 14, and board S is pressed against printing region R of mask M by board holding device 16. As shown in FIG. 7A, squeegee 48*a* is positioned forward of the creamed solder on collecting plate 72. At this time, squeegee 48*a* is brought into contact with the upper face of collecting plate 72. Thereafter, as shown in FIG. 7B, the cream solder on collecting plate 72 is moved rearward by moving squeegee 48*a* rearward, and the cream solder is lowered onto mask M in front of the front end of printing region R. Therefore, before squeegee 48*a* enters printing region R of mask M, collecting plate 72 is disposed forward of squeegee 48*a*, that is, forward of squeegee 48*a* on the front end side of mask M.

Next, as shown in FIG. 7C, squeegee 48*a* is moved rearward while being in contact with mask M. As a result, the cream solder is moved rearward on printing region R along mask M, and is printed on board S through the through holes formed in printing region R on board S. When squeegee 48*a* is moved rearward, collecting plate 72 is moved rearward so as to follow squeegee 48*a* in a state in which it abuts on mask M. While collecting plate 72 follows squeegee 48*a*, scraping units 98*a* and 98*b* of scraper 74 are moved rearward in a state of being in contact with mask M, and the cream solder protruding outward from squeegee 48*a* in the left-right direction is scraped.

Squeegee 48*a* is moved rearward until passing by the tail end of printing region R. Thereafter, collecting plate 72 is moved to a position higher than the creamed solder, and squeegee 48*a* is moved to a position higher than collecting plate 72, as indicated by a dashed line in FIG. 7D. In this state, collecting plate 72 is moved rearward until it overtakes squeegee 48*a*. As a result, collecting plate 72 is positioned rearward of squeegee 48*a*, as indicated by the solid line in FIG. 7D. Therefore, after rearward-moving squeegee 48*a* passes by printing region R of mask M, collecting plate 72 is disposed rearward of squeegee 48*a*, that is, rearward of squeegee 48*a* on the tail end side of mask M. Subsequently, as shown in FIG. 7E, squeegee 48*a* and collecting plate 72 are moved downwardly until being in contact with mask M.

Next, as shown in FIG. 7F, squeegee 48*a* is moved further rearward, and the creamed solder is placed on collecting plate 72. Thereafter, squeegee 48*a* and collecting plate 72 are moved upward to be spaced apart from mask M. Squeegee 48*a* and collecting plate 72 are moved forward while holding a positional relationship of the front and the rear, as shown in FIG. 7G. Squeegee 48*a* and collecting plate 72 are moved to the front end of mask M and then lowered onto mask M and returned to the state shown in FIG. 7A. Thereafter, board S on which printing has been completed is moved downward by board holding device 16, and is spaced apart from mask M. Subsequently, board S on which printing has been completed is carried out by board conveyance device 14, and board S to be printed next is carried in.

Figure 8:
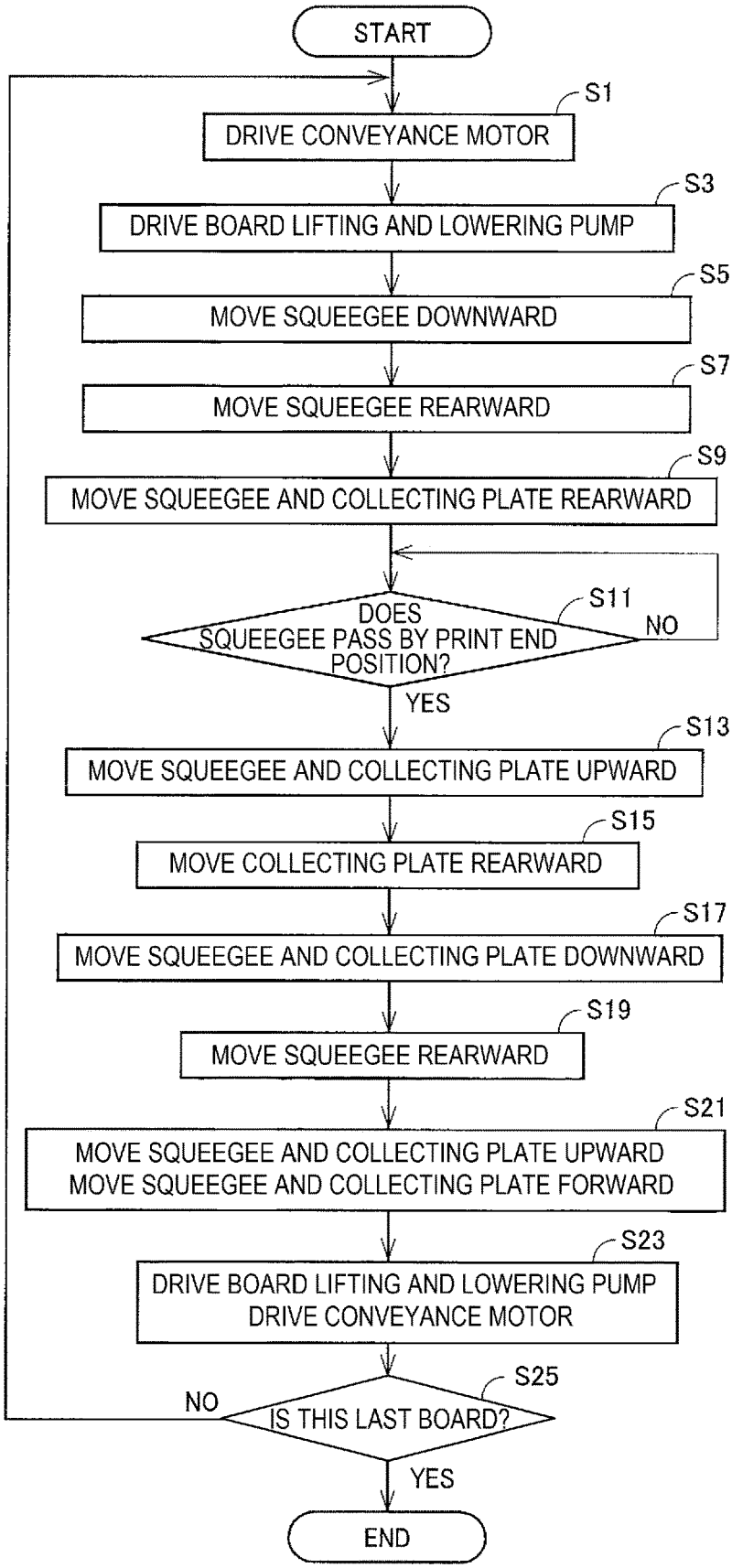
FIG. 8 is a flowchart illustrating a process of one-way printing by the screen printing machine in the first embodiment.

Hereinafter, specific control at the time of the solder printing operation will be described. FIG. 8 is a flowchart showing processing executed by control device 100 during the solder printing operation. After collecting plate 72 on which the cream solder is placed is set on second slider 84 by the operator, control device 100 starts the processing by the flow. In Step 1 (hereinafter, abbreviated as "S1", and the same applies to other steps), control device 100 drives conveyance motor 32 to convey board S onto holding member 34. Next, in S3, control device 100 drives board lifting and lowering pump 104 to move board S upward and press board S against the lower face of printing region R of mask M. Then, control device 100 drives the squeegee lifting and lowering pump 108*a* at S5 and moves squeegee 48*a* downward until coming into contact with collecting plate 72.

In S7, control device 100 supplies a current to squeegee moving motor 56 to move squeegee 48*a* rearward until squeegee 48*a* is positioned rearward of collecting plate 72. In S9, control device 100 supplies current to squeegee moving motor 56 and collecting plate moving motor 80 until squeegee 48*a* and collecting plate 72 are positioned behind the front end of printing region R. In S11, control device 100 refers to the value of the squeegee position sensor 112*a* so as to determine whether or not the value indicating the position of squeegee 48*a* exceeds the value indicating the position of the tail end of printing region R set in advance. If squeegee 48*a* has passed by the tail end of printing region R, the process proceeds to S13, and if not, S11 is repeated.

In S13, control device 100 drives collecting plate lifting and lowering pump 110 until collecting plate 72 is positioned above the cream solder. Next, squeegee lifting and lowering pump 108*a* is driven until squeegee 48*a* is positioned above collecting plate 72. Next, in S15, control device 100 supplies a current to collecting plate moving motor 80 until collecting plate 72 is positioned behind squeegee 48*a*. In S17, control device 100 drives squeegee lifting and lowering pump 108*a* and collecting plate lifting and lowering pump 110 until squeegee 48*a* and collecting plate 72 abut on mask M. Next, in S19, control device 100 supplies a current to squeegee moving motor 56 until squeegee 48*a* rides on the upper face of collecting plate 72.

In S21, control device 100 drives squeegee lifting and lowering pump 108*a* and collecting plate lifting and lowering pump 110 until squeegee 48*a* and collecting plate 72 are spaced apart upward from mask M. Thereafter, control device 100 supplies current to squeegee moving motor 56 and collecting plate moving motor 80 until squeegee 48*a* and collecting plate 72 are positioned at the front end of mask M. In S23, control device 100 drives board lifting and lowering pump 104 to move board S downward, and drives conveyance motor 32 to convey board S to the mounting device. In S25, control device 100 determines whether or not the current board S has become the last board to be printed. If the current board is not the last board, the process returns to S1, and if the current board is the last board, the process according to the flow ends.

As described above, in screen printing machine 10 according to the embodiment, when squeegee 48*a* is between the front end of mask M and the front end of printing region R, collecting plate 72 is disposed forward of squeegee 48*a*. As a result, printing can be started without changing the positions of squeegee 48*a* and collecting plate 72. After squeegee 48*a* passes by the tail end of printing region R, collecting plate 72 passes between squeegee 48*a* and the cream solder, thereby collecting plate 72 can be disposed rearward of squeegee 48*a* while minimizing the movement of collecting plate 72 in the up-down direction. As a result, the cream solder can be collected from collecting plate 72 by the rearward movement of squeegee 48*a*.

The cream solder collected on collecting plate 72 is returned to the front end of mask M while being placed on collecting plate 72. Therefore, the cream solder is moved only rearward without being moved forward on mask M. That is, screen printing machine 10 can print multiple boards in one direction. As a result, it is possible to suppress variations in the quality of printing due to differences in the printing direction. Further, since scraper 74 is provided not on squeegee 48*a* but on collecting plate 72, it is not necessary to change the height of scraper 74 in accordance with the change in the height of squeegee 48*a*. Therefore, the operation can be simplified. Further, since scraper 74 is disposed outside squeegee 48*a* in the left-right direction, the cream solder that protrudes outside squeegee 48*a* in the left-right direction can be collected in collecting plate 72.

The cream solder in the embodiment is an example of a viscous fluid, and collecting plate 72 is an example of a collection member. The front end of mask M is an example of the first end, and the tail end of mask M is an example of the second end. The direction from the front end to the tail end of mask M is an example of the first direction, and the direction from the tail end to the front end of mask M is an example of the second direction. Squeegee lifting and lowering pumps 108*a* and 108*b*, squeegee moving motor 56, collecting plate moving motor 80, and collecting plate lifting and lowering pump 110 are examples of driving sections, and control device 100 is an example of a control section.

Although the embodiments of the present disclosure have been described above, the present disclosure is not limited to the above-described embodiments, and various modifications can be made without departing from the gist of the present disclosure. In the embodiment, as shown in FIG. 7B, squeegee 48*a* is moved rearward to lower the cream solder from collecting plate 72 onto mask M, but the present disclosure is not limited to this, and, for example, the cream solder may be moved by moving collecting plate 72 forward. As shown in FIG. 7E, squeegee 48*a* is moved rearward to collect the cream solder on collecting plate 72, but the present disclosure is not limited to this, and, for example, collecting plate 72 may be moved forward to collect the cream solder.

As shown in FIG. 7D, after the print is completed, collecting plate 72 is disposed at a position higher than the cream solder and lower than squeegee 48*a* and moved rearward, but the present disclosure is not limited to this, and for example, collecting plate 72 may be moved rearward at a position higher than squeegee 48*a*. In the embodiment, collecting plate 72 disposed forward of squeegee 48*a* overtakes squeegee 48*a* and is disposed rearward of squeegee 48*a*, but the timing of overtaking is not limited to the timing shown in FIG. 7D. The overtaking of squeegee 48*a* by collecting plate 72 may be performed at any timing between the time the cream solder is lowered from collecting plate 72 onto mask M and the time the cream solder is collected from mask M onto collecting plate 72, for example, the overtaking of collecting plate 72 may be performed immediately after the cream solder is lowered from collecting plate 72 onto mask M or when squeegee 48*a* is moving within printing region R of mask M.

REFERENCE SIGNS LIST

10: Screen printing machine
12: Printer main body
14: Board conveyance device

16: Board holding device
18: Mask holding device
22: Squeegee device
24: Solder collecting device
26: Main body frame
28: Cover
30*a*, 30*b*: Conveyor belt
32: Conveyance motor
34: Holding member
36: Board lifting and lowering device
38: Mask frame
42: Squeegee moving device
44: Squeegee head
46*a*, 46*b*: Squeegee lifting and lowering device
48*a*, 48*b*: Squeegee
50*a*, 50*b*: First guide rail
52: First conveyor
56: Squeegee moving motor
58: First slider
60: First conveyor belt
62*a*, 62*b*: First pulley
68: Collecting plate moving device
72: Collecting plate
74: Scraper
76*a*, 76*b*: Second guide rail
78: Second conveyor
80: Collecting plate moving motor
82*a*, 82*b*: Air cylinder
84: Second slider
86: Second conveyor belt
88*a*, 88*b*: Second pulley
92: Horizontal surface
94*a*, 94*b*: Inclined surface
95: guide groove
96*a*, 96*b*: Support portion
98*a*, 98*b*: Scraping unit
100: Control device
102: Drive circuit
104: Board lifting and lowering pump
106: Mask fixing pump
108*a*, 108*b*: Squeegee lifting and lowering pump
110: Collecting plate lifting and lowering pump
112*a*, 112*b*: Squeegee position sensor
114: Collecting plate position sensor
M: Mask
R: Printing region
S: Board

The invention claimed is:

1. A screen printing machine comprising:

a main body frame;

a squeegee configured to be used for printing a viscous fluid on a mask placed on the main body frame on a board and to be movable in a first direction from a first end to a second end of the mask;

a collection member configured to be movable in the first direction and collect the viscous fluid moved by the squeegee; and a driving section configured to move the squeegee and the collection member, wherein the driving section moves the collection member closer to the first end side of the mask than the squeegee before the squeegee moving in the first direction enters a printing region of the mask, and after the squeegee moving in the first direction passes by the printing region of the mask, the driving section moves the collection member from the first end side of the mask to the second end side of the mask with the collection member and the squeegee at a position higher than the viscous fluid.

2. The screen printing machine according to claim 1, wherein before the squeegee enters the printing region of the mask, the driving section moves at least one of the squeegee and the collection member so that the collection member is disposed on the first end side of the mask with respect to the squeegee, and the driving section moves the viscous fluid placed on the collection member onto the mask.

3. The screen printing machine according to claim 1, wherein the squeegee and the collection member are movable in an up-down direction, at least one of the squeegee and the collection member are driven to move the viscous fluid placed on the collection member onto the mask before the squeegee moving in the first direction enters the printing region of the mask, and move the viscous fluid placed on the mask onto the collection member after the squeegee passes by the printing region of the mask, and wherein the driving section moves the collection member from the first end side of the mask to the second end side of the mask with respect to the squeegee with a height of the collection member set to differ from a height of the squeegee during a period from when the viscous fluid is moved from the collection member onto the mask until the viscous fluid is moved from the mask onto the collection member.

4. The screen printing machine according to claim 3, wherein the collection member is disposed at a position lower than the squeegee, during a period from when the squeegee passes by the printing region of the mask until the viscous fluid is moved from the mask onto the collection member.

5. The screen printing machine according to claim 1, wherein the driving section moves at least one of the squeegee and the collection member so that the collection member disposed on the second end side of the mask with respect to the squeegee comes into contact with the squeegee after the squeegee passes by the printing region of the mask, and moves the viscous fluid placed on the mask onto the collection member.

6. The screen printing machine according to claim 1, wherein the squeegee and the collection member are movable in a second direction opposite to the first direction, wherein at least one of the squeegee and the collection member is driven to move the viscous fluid placed on the mask onto the collection member after the squeegee passes by the printing region of the mask, and wherein the driving section moves the squeegee and the collection member in the second direction so that the collection member is disposed between the printing region of the mask and the first end of the mask, after the viscous fluid is moved from the mask onto the collection member.

7. The screen printing machine according to claim 1, further comprising:

a scraper which is attached to the collection member and is configured to collect the viscous fluid protruding outward from the squeegee in a longitudinal direction of the squeegee when the squeegee is moved in the first direction.

8. The screen printing machine according to claim 7, wherein the collection member is disposed so that a longitudinal direction of the collection member is parallel to the longitudinal direction of the squeegee, wherein the scraper includes two scraping units provided to be spaced apart from each other in the longitudinal direction of the collection member, and wherein each of the two scraping units is formed to extend from the collection member in a direction including a component of the first direction and to have a tip end which is positioned outside the squeegee in the longitudinal direction of the squeegee.

9. The screen printing machine according to claim 1, wherein the driving section moves the squeegee to move the viscous fluid onto the collection member after the collection member is moved to the second side.

10. A screen printing system comprising:

a main body frame;

a squeegee configured to be used for printing a viscous fluid on a mask placed on the main body frame on a board and to be movable in a first direction from a first end to a second end of the mask;

a collection member configured to be movable in the first direction and collect the viscous fluid moved by the squeegee;

a driving section configured to move the squeegee and the collection member; and a control section configured to control the driving section, wherein the control section controls the driving section so that the collection member is disposed closer to the first end side of the mask than the squeegee before the squeegee moving in the first direction enters a printing region of the mask, and the control section controls the driving section so that after the squeegee moving in the first direction passes by the printing region of the mask, the driving section moves the collection member from the first end side of the mask to the second end side of the mask with the collection member and the squeegee at a position higher than the viscous fluid.

* * * * *